United States Patent [19]

Suzuki et al.

[11] 4,440,198

[45] Apr. 3, 1984

[54] APPARATUS FOR GUIDING WEFT YARNS IN A JET LOOM

[75] Inventors: Hajime Suzuki, Anjyo; Hiroshi Arakawa, Kariya, both of Japan

[73] Assignee: Kabushiki Kaisha Toyoda Jidoshokki Seisakusho, Kariya, Japan

[21] Appl. No.: 356,360

[22] Filed: Mar. 9, 1982

Related U.S. Application Data

[63] Continuation of Ser. No. 129,411, Mar. 11, 1980, abandoned.

[30] Foreign Application Priority Data

Mar. 17, 1979 [JP] Japan ..... 54-31340
Jun. 25, 1979 [JP] Japan ..... 54-79102

[51] Int. Cl.[3] ..... D03D 47/30
[52] U.S. Cl. ..... 139/435
[58] Field of Search ..... 139/435; 226/97

[56] References Cited

U.S. PATENT DOCUMENTS

| | | | |
|---|---|---|---|
| 3,065,770 | 11/1962 | Svaty et al. | 139/435 |
| 3,139,118 | 6/1964 | Svaty et al. | 139/435 |
| 3,742,973 | 7/1973 | Kakac | 139/435 |
| 3,818,952 | 6/1974 | Vermeulen et al. | 139/435 |
| 3,821,972 | 7/1974 | Svaty et al. | 139/435 |
| 4,127,148 | 11/1978 | Larmit | 139/435 |
| 4,190,067 | 2/1980 | Kuda et al. | 139/435 |
| 4,244,402 | 1/1981 | Hasegawa et al. | 139/435 |

FOREIGN PATENT DOCUMENTS

| | | | |
|---|---|---|---|
| 2600369 | 7/1977 | Fed. Rep. of Germany | 139/435 |
| 2022630 | 12/1979 | United Kingdom | 139/435 |

*Primary Examiner*—Henry Jaudon
*Attorney, Agent, or Firm*—Wenderoth, Lind & Ponack

[57] ABSTRACT

An apparatus is provided for guiding a weft yarn into the shed of a jet loom by a number of weft guiding members, each having an aperture with an opening. The weft guiding members are composed of a first group of weft guiding members of which the openings are of a relatively narrow width and formed in upper parts of the weft guiding members in the first group, and a second group of weft guiding members of which the openings are of a relatively broad width and formed in side parts of the weft guiding members in the second group. In front of the opening in each of the weft guiding members in the second group are sub-nozzles each having at least one fluid outlet discharging a jet of fluid to assist the weft yarn in being inserted into the shed so that the fluid jet produced by the respective sub-nozzle is obliquely directed toward surfaces of the apertures of the weft guiding members in the first group downstream of the respective sub-nozzle with respect to the direction in which the weft yarn is inserted, which surfaces are positioned on the side opposite to the sub-nozzles.

11 Claims, 6 Drawing Figures

APPARATUS FOR GUIDING WEFT YARNS IN A JET LOOM

This is a continuation of Ser. No. 129,411, filed Mar. 11, 1980 now abandoned.

BACKGROUND OF THE INVENTION

This invention relates to an apparatus for guiding a weft yarn passing through a shed formed between warp yarns in a so-called jet loom.

In the past, in order to insert the weft yarn more smoothly into the shed formed between the upper and lower warp yarns, various designs for a weft yarn guiding apparatus have been produced. For example, a guiding apparatus has been known, which comprises a number of weft yarn guiding members arranged in spaced relationship in the direction of the weft insertion with apertures forming a continuous channel, through which the weft yarn is passed during the insertion thereof, each aperture having a large opening formed on the side of the reed, and a suitable number of sub-nozzles positioned in places along the channel so that their fluid outlets open into the channel. With this guiding apparatus, during the insertion of the weft yarn, the weft yarn is fed into the channel by a jet of fluid produced by a main nozzle positioned in alignment with the channel, while each of the sub-nozzles produces a jet of fluid acting on the weft yarn in cooperation with the main jet of fluid to make up the shortage of feed distance of the weft yarn, which would occur if the sub-nozzles were not employed, thus assisting the weft yarn in being fed smoothly through the channel.

However, in the afore-mentioned apparatus, because of the large opening formed in each of the weft guiding members, the fluid discharged from both the main and sub-nozzles is subject to escape from the openings, resulting in a greater consumption of the fluid. Moreover, because the jet of fluid produced by each sub-nozzle is directed toward the downstream weft guiding members at a certain angle with respect to the weft inserting direction so as to blow against the aperture surfaces of the downstream weft guiding members opposite to the large openings and thereafter is deflected at a large angle close to about 90° with respect to the weft inserting direction, i.e., the weft yarn being fed through the apertures, the leading end of the weft yarn is apt to be entrained by the deflected flow of fluid, resulting in the disadvantage of passing out of the channel through the large openings during the insertion of the weft yarn. Such a disadvantage would be conspicuous especially when the leading end of the weft yarn deviates from the path of the main jet of fluid produced by the main nozzle. Also, it will be understood that the disadvantages of greater fluid consumption and unreliability of weft insertion would become a common phenomenon were a higher speed of the main and sub-fluid jets to be employed to increase the speed of weft insertion.

As a weft guiding apparatus which would appear to remove the disadvantages in the afore-mentioned weft guiding apparatus, a weft guiding apparatus with no sub-nozzles has been provided, which comprises a number of weft guiding members each having a substantially circular aperture with a small opening formed in the upper portion of each weft guiding member. However, this weft guiding apparatus has not been favourably used, because the above-discussed disadvantage of the unreliability of weft insertion has not yet been eliminated. Since the opening provided in each weft guiding member is of a slit-like shape greatly narrowed to such an extent that the weft yarn barely escapes therefrom, a relatively high differential pressure will develop between the inside and outside of the channel defined by the apertures when the fluid is discharged into the channel from the main nozzle. This causes a speed of fluid escaping or leaking through the slit-like opening to be greatly increased and the leading end of the weft yarn may be entrained by the fluid flow escaping at an increased speed, thus coming out of the channel through the slit-like opening. Therefore, it is understood that although the weft guiding apparatus with no sub-nozzles is considered to be reasonably improved in fluid consumption, it is still not able to provide sufficiently good reliability of weft insertion, which is the most important characteristic required in a weft guiding apparatus.

Then, in view of the above requirement, it has been attempted to provide each weft guiding member with an elastic tongue, which normally closes the inlet of the aperture's narrow opening, but, prior to the beating, opens the same by being deformed in terms of the inserted weft yarn to allow for the beating. Also, it has been attempted to provide each of the selected weft guiding members with a fluid passage, which has fluid outlets at positions circumferentially arranged around the aperture of the weft guiding member to supply a plurality of jets of fluid surrounding the fluid jet produced by the main nozzle. However, such attempts would involve additional disadvantages in that the weft guiding member is of a relatively complex construction and problems are encountered in the design of the elastic tongue and the fluid outlets, resulting in difficulties and increased costs in the manufacture thereof.

Therefore, it will be readily understood that a weft yarn guiding apparatus has been required, which enables weft insertion to be accomplished without failure at a reduced rate of fluid consumption, and which can be manufactured at a reduced cost.

SUMMARY OF THE INVENTION

This invention generally relates to an apparatus for guiding a weft yarn when it is inserted into a shed, formed between lower and upper warp yarns, by a jet of fluid discharged from a main fluid nozzle positioned beside a jet loom. Such apparatus generally comprises a number of weft guiding members arranged in spaced relationship with each other and in parallel to a reed of the jet loom, the weft guiding members each having an aperture with an opening to allow the weft yarn to come out of the apertures after it has been inserted into the shed. A continuous weft guiding channel is provided by means of the apertures.

According to this invention, the weft guiding members are composed of a first group of weft guiding members of which the openings are of a relatively narrow width and formed in upper parts of the first group of weft guiding members, and a second group of weft guiding members of which the openings are of a relatively broad width and formed in side parts of the second group of weft guiding members on the side of the reed, each of the second group of weft guiding members being interposed between adjacent two of the first group of weft guiding members with their apertures positioned in alignment with each other with respect to a direction in which the weft yarn is inserted. The apparatus further comprises sub-nozzles each having at least one fluid outlet discharging a jet of fluid to assist the fluid jet produced by the main nozzle in inserting the weft yarn into the shed, the fluid outlet being positioned substantially in alignment with the corresponding weft guiding member in the second group with respect to a direction of the warp yarn so as to face the broad opening of the aperture in the corresponding weft guiding member in the second group so that the fluid jet produced by the respective sub-nozzle is obliquely directed toward surfaces of the apertures in the first group of weft guiding members downstream of the associated sub-nozzle with respect to the direction in which the weft yarn is inserted, which surfaces are positioned away from the reed. This arrangement can effectively achieve the above object of this invention and enables high speed insertion of the weft yarn into the shed.

In the preferred embodiments, the surfaces of the apertures in the first group of weft guiding members, toward which the fluid jet produced by the sub-nozzle is directed, extend substantially straight so as to more effectively prevent unexpected escape of the weft yarn from the channel.

BRIEF DESCRIPTION OF THE DRAWINGS

This invention will be more readily understood from the following description of the preferred embodiments shown, by way of example only, in the accompanying drawings, wherein.

DESCRIPTION OF THE PREFERRED EMBODIMENTS

Figure 1:
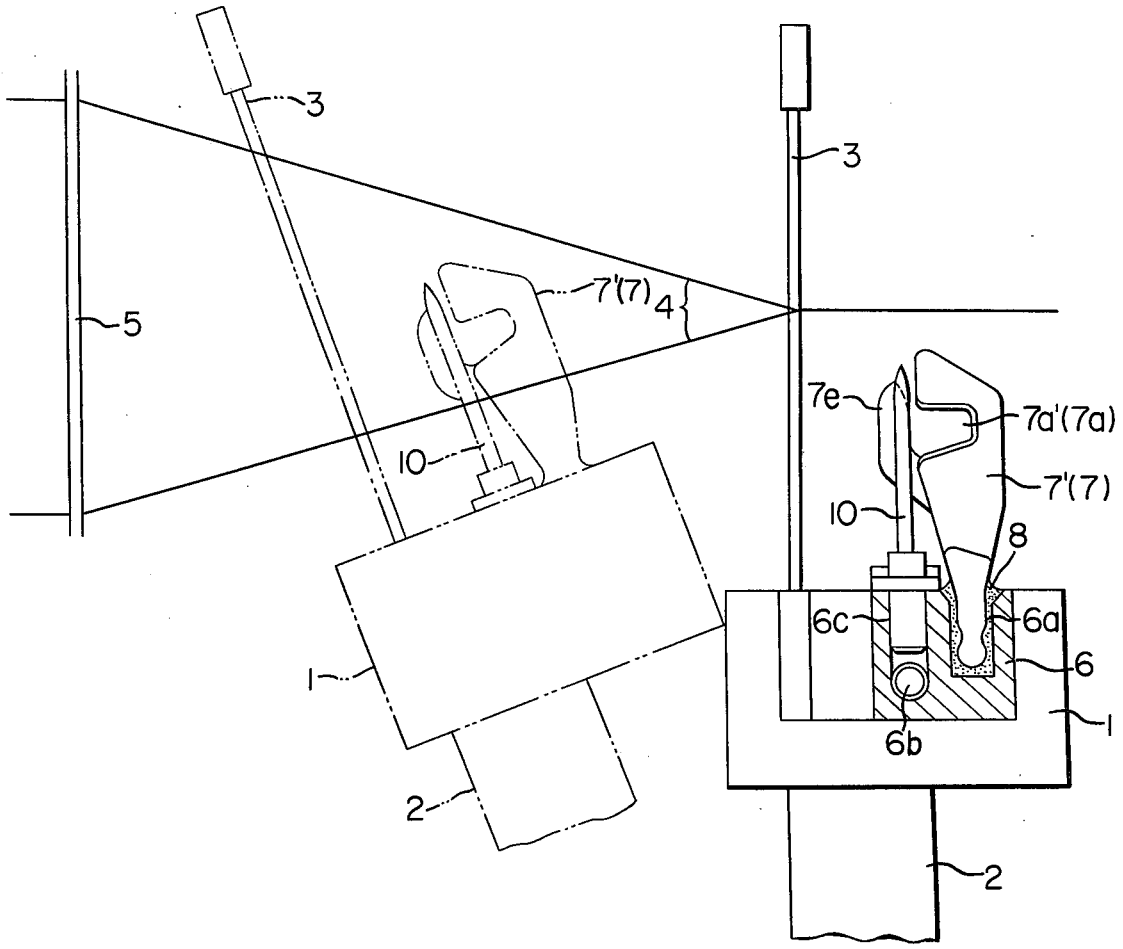
FIG. 1 is a side elevational view showing, partly in section, a beating apparatus incorporating a weft guiding apparatus constructed in accordance with this invention.
Figure 2:
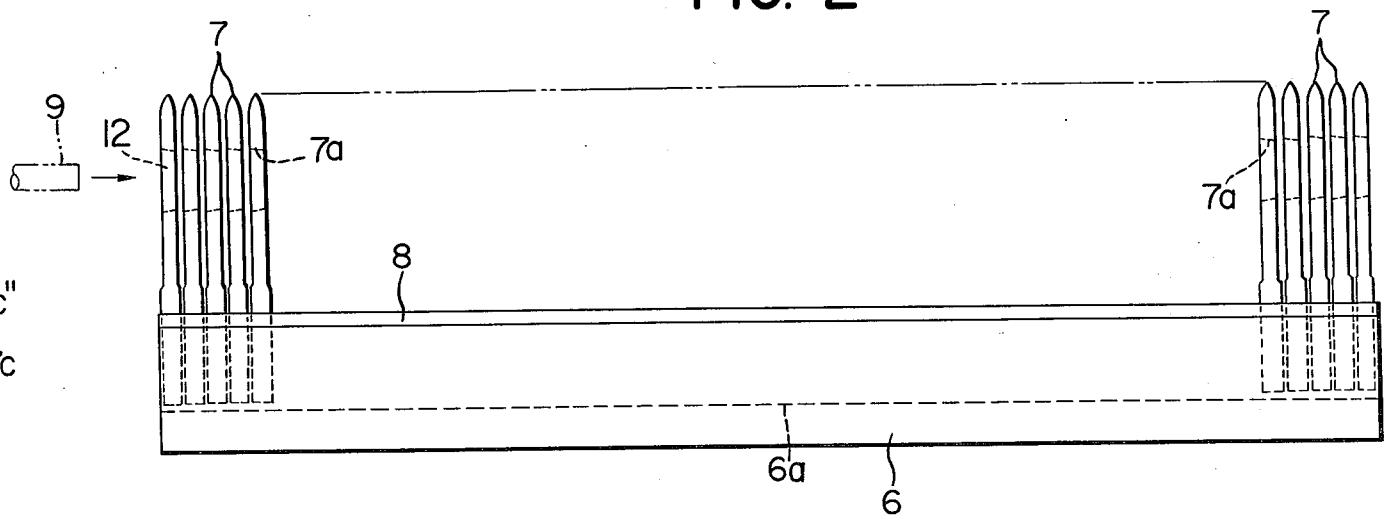
FIG. 2 is a front elevational view of the weft guiding apparatus, part of which is omitted for the purpose of simplification.

Referring now to FIG. 1, there is shown a beating apparatus incorporating a weft guiding apparatus according to this invention. As is known, the beating apparatus includes rockable slay swords 2 supporting a beam 1 secured thereto by a suitable means, and a reed 3 mounted in a groove of the beam 1. The jet loom includes healds 5 to cause warp yarns 4 to form the shed, into which a weft yarn is to be inserted with a pneumatic picking mechanism including a main nozzle 9 (FIG. 2).

In the groove of the beam 1, an elongated mounting bar 6 having a rectangular cross-section is also fixedly mounted in a suitable conventional manner to mount therein the weft guiding apparatus of this invention. For this purpose, the mounting bar 6 in its upper surface is provided with a longitudinally extending groove 6*a*, and a suitable number of holes 6*c* arranged in spaced relationship along the length of the groove 6*a* and each being in fluid communication with a longitudinally extending fluid passage 6*b* formed in the mounting bar 6. The weft guiding apparatus includes a plurality of sub-nozzles 10 corresponding in number to the holes 6*c* and having their root portions fitted into the corresponding holes 6*c*. Each of the sub-nozzles 10 is in the form of a pipe with a closed sharp free end. The weft guiding apparatus, as clearly shown in FIG. 2, further includes an array of weft guiding members 7 and 7' fixedly mounted in the groove 6*a* by such means as a suitable adhesive 8. Apartures 7*a* and 7*a'* are formed respectively in the weft guiding members 7 and 7' to provide a weft guiding channel 12, through which the weft yarn is inserted into the shed mainly by a jet of fluid, such as air, produced by the main nozzle 9. Each aperture converges toward the downstream side.

Figure 3:
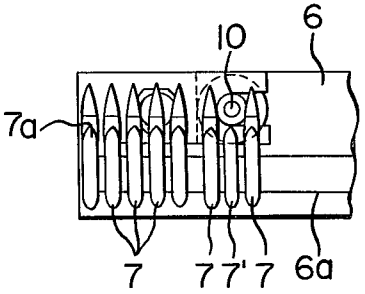
FIG. 3 is a fragmental plan view showing the left end portion of the weft guiding apparatus.
Figure 4:
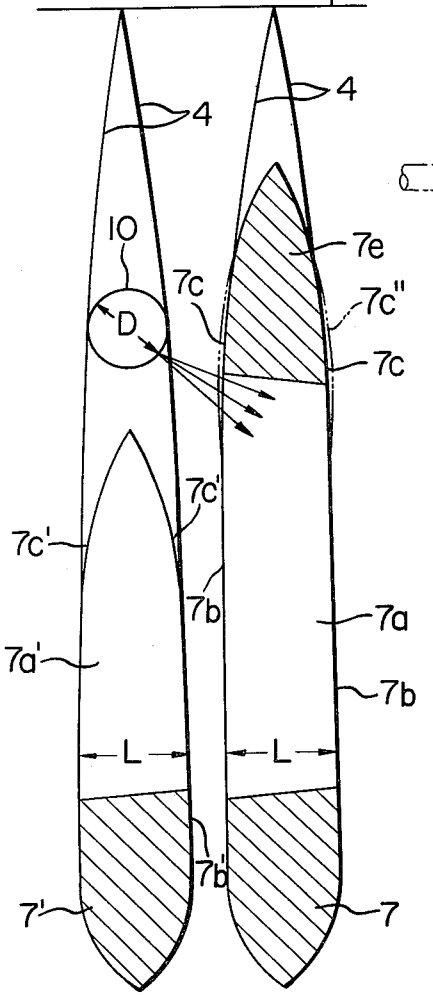
FIG. 4 is a sectional plan view, on an enlarged scale, of the weft guiding apparatus of this invention.

As best shown in FIGS. 3 and 4, each of the weft guiding members 7' is positioned in alignment with the corresponding sub-nozzle 10 with respect to the direction of the warp yarn 4. It will be understood that between the weft guiding members 7' the plurality of weft guiding members 7 are so disposed that their apertures 7*a* are aligned with the apertures 7*a'* of the weft guiding members 7'. The sub-nozzle 10 has an outer diameter D smaller than the thickness L of at least the weft guiding member 7'. However, the outer diameter D may be equal to the thickness L.

Figure 5A:
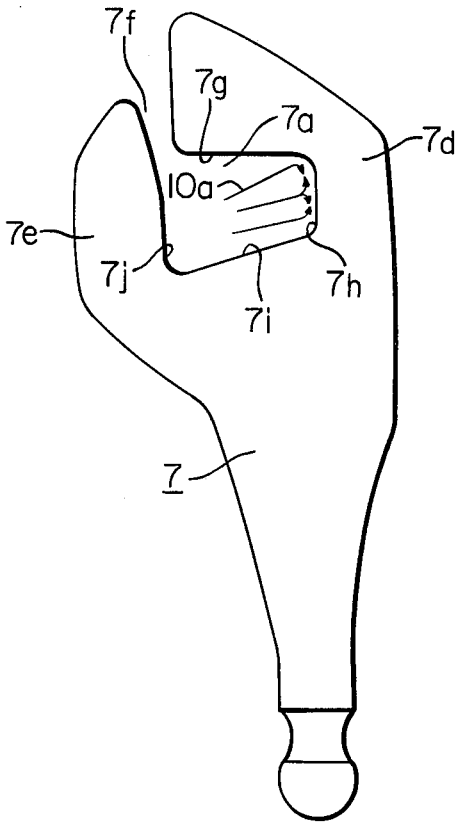
FIGS. 5A and 5B are side elevational views of weft guiding members employed in the weft guiding apparatus of this invention shown in FIGS. 1 to 4.
Figure 5B:
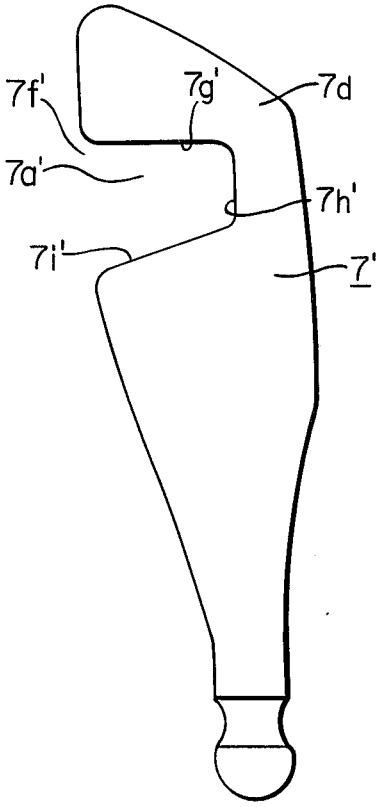

In FIGS. 5A and 5B, the weft guiding members 7 and 7' are shown on an enlarged scale. The weft guiding member 7' is of the rather "open" type wherein the aperture 7*a'* has a larger opening 7*f* on the side of the reed 3 (FIG. 1), while the weft guiding member 7 is of the rather "closed" type wherein the aperture 7*a* has a smaller opening 7*f* in the upper portion of the guiding member 7 on the side thereof facing the reed. The guiding member 7 is bifurcated into a first curved portion 7*d* and a second, substantially straight portion 7*e*, the free ends of these portions 7*d* and 7*e* being close to each other forming the narrow opening 7*f*. As shown in FIG. 4, the second portion 7*e* is substantially in alignment with the sub-nozzle 10 with respect to the weft inserting direction. The aperture 7*a* defined or surrounded by these portions 7*d* and 7*e* comprises substantially straightly extending or flat upper, inner, lower and outer surfaces 7*g*, 7*h*, 7*i* and 7*j* connected with each other by the curved surfaces. The weft guiding member 7' may be considered to correspond to the weft guiding member 7, from which the second portion 7*e* has been removed, and therefore its aperture 7*a'* is defined only by the first portion 7*d* and does not include the upwardly straightly extending flat surface 7*j* on the second portion 7*e*.

Figure 6A:
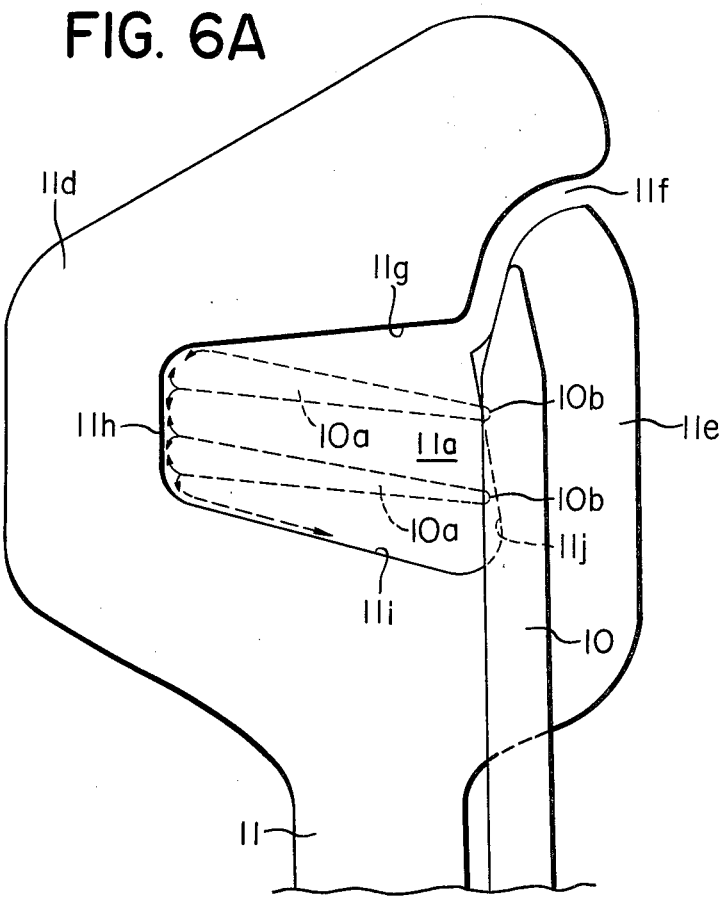
FIGS. 6A and 6B are side elevations of another embodiment of this invention, in which a sub-nozzle is so arranged as to position its fluid outlets within a weft guiding channel.
Figure 6B:
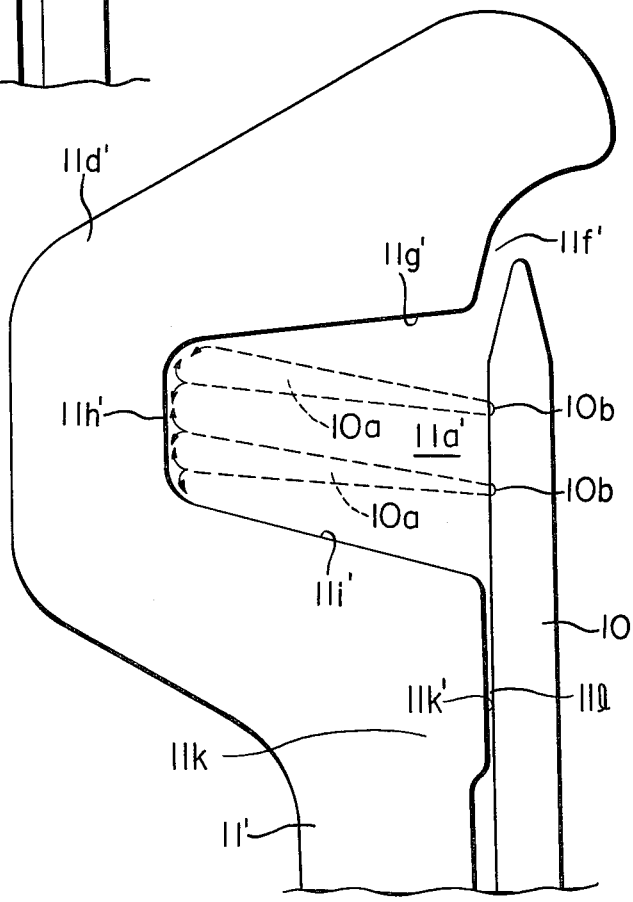

FIGS. 6A and 6B show another embodiment of this invention, which substantially corresponds to the previous embodiment, except that each sub-nozzle 10 is so arranged as to position its fluid outlets 1O*b* within the weft guiding channel 12. Therefore, it is apparent that the majority of the following description concerning weft guiding members 11 and 11' shown in FIGS. 6A and 6B is also applicable to the previous embodiment with the above exception.

In FIG. 6A, the weft guiding member 11 is bifurcated into a first curved portion 11*d* and a second, substantially straightly extending portion 11*e* to form an aperture 11*a* therebetween, the free end of the first portion 11*d* being extended over and close to that of the second portion 11*e* to form a narrow and curved slit-like opening 11*f* to allow the weft yarn to come out of the aperture 11*a* after it has been inserted into the shed. The inside of the first portion 11*d* is composed of an upper straightly extending surface 11*g*, which is substantially horizontal when the apparatus is in the weft inserting position, an inner straightly extending surface 11*h* connected through curved surface to the inner end of the upper surface 11*g* and substantially perpendicularly extending relative to the upper surface 11*g*, and a lower straightly extending surface 11*i* connected through a curved surface to the lower end of the inner surface 11*h* and inclined downward toward the outer end thereof. Thus, these surfaces 11*g*, 11*h* and 11*i* are so arranged as to form a U-shape. The upper surface 11*g* is in obtuse-angled relationship with the curved narrow opening 11*f*. On the other hand, the outer straightly extending surface 11*j* on the inside of the second portion 11*e* is connected through a curved surface to the outer end of the lower surface 11*i* of the first portion 11*d* and extends upward while inclining inwardly toward the outer end of the upper surface 11*g*. Since the lower surface 11*i* is inclined downwardly toward the lower end of the outer surface 11*j* which is, in turn, inclined inwardly toward the outer end of the upper surface 11*g*, the total length of the surfaces 11*i* and 11*j* can be elongated.

In FIG. 6B, the weft guiding member 11′ comprises an arm portion 11*d*′ having a configuration similar to that of the first portion 11*d* of the weft guiding member 11 and forming an aperture 11*a*′. In a position in which, if the guiding member 11′ were the guiding member 11, the second portion 11*e* would be positioned, a sub-nozzle 10 is separately disposed so as to form a relatively narrow opening 11*f*′ between the conical end of the sub-nozzle 10 and the free end of the arm portion 11*d*′, the opening 11*f*′ having a configuration substantially corresponding to that of the lower half of the opening 11*f* discussed with reference to guiding member 11. Since the configuration of the weft guiding member arm portion 11*d*′ substantially corresponds to that of the first portion 11*d* of the weft guiding member 11, the arm portion 11*d*′ also contains straight surfaces 11*g*′, 11*h*′ and 11*i* closely resembling the above-mentioned surfaces 11*g*, 11*h* and 11*i* of the weft guiding member 11. However, the lower surface 11*i*′ terminates at a position close to the cylindrical surface of the sub-nozzle 10 and a neck 11*k* connecting the curved portion 11*d*′ to the body of the weft guiding member 11′ includes a surface 11*k*′ extending in parallel to the sub-nozzle 10 with a very narrow spacing 11*l* therebetween.

As shown in FIG. 6A, the sub-nozzle 10, disposed on the opened side of the aperture 11*a*′ in alignment therewith with respect to the direction of the warp yarn as shown in FIG. 6B, is adapted to allow the fluid outlets 10*b* formed therein to be positioned slightly inside of the aperture 11*a*, i.e., inwardly of the outer surface 11*j* when looking in the direction of the weft insertion.

Next, the operation of the above embodiments of the weft guiding apparatus will be described.

In FIG. 1, the solid lines show the beating apparatus in the condition that one cycle of the beating operation has been completed. At that time, the weft guiding apparatus comprising the sub-nozzles 10 and the array of weft guiding members 7 and 7′ is brought out of the shed formed by the warp yarns 4. When the rockable slay swords 2 turn back, or leftwardly in FIG. 1, from the position shown by the solid lines, the healds 5 move vertically to cause the warp yarns 4 to form the shed again therebetween and the weft guiding apparatus enters the shed as shown by the dot and dash lines in FIG. 1. Then, the main nozzle 9 (FIG. 2) discharges the jet of fluid, by which the weft yarn is entrained and inserted into the continuous channel 12 formed by the apertures 7*a* and 7*a*′ of the weft guiding members 7 and 7′. In the meantime, jets of fluid are also discharged from the sub-nozzles 10 to assist the main jet produced by the main nozzle 9 in feeding the weft yarn through the channel 12.

It is again stated that the weft guiding apparatus of this invention comprises the weft guiding members 7′ or 11′ each having the aperture 7*a*′ or 11*a*′ of the rather "open" type greatly opened at the reed side thereof, the sub-nozzles 10 disposed on the reed side of the "open" type apertures 7*a*′ or 11*a*′, and the weft guiding members 7 or 11 each having the aperture 7*a* or 11*a* of the rather "closed" type slightly opened at the upper side thereof and positioned in alignment with the "open" type apertures 7*a*′ or 11*a*′ with respect to the weft inserting direction. Also, the sub-nozzles 10 are positioned to be aligned with the second arm portions 7*e* and 11*e* of the weft guiding members 7 and 11 with respect to the weft inserting direction. With the weft guiding apparatus as constructed above, when the weft yarn, entrained by the main jet of fluid produced by the main nozzle 9, travels through the apertures 7*a* and 7*a*′ or 11*a* and 11′, it is forced, by the jets of fluid produced by the sub-nozzles 10, toward the side of the inner surfaces 7*h* or 11*h* of the apertures 7*a* or 11*a* opposite to the openings 7*f* or 11*f*. Moreover, the sub-nozzles 10 and the second arms 7*e* or 11*e* of the weft guiding members 7 or 11 serve to separate the apertures 7*a*′ and 11*a*′ and 7*a* or 11*a* from the outside atmosphere, thereby preventing the fluid blown against and deflected by the inner surfaces 7*h* or 11*h* from directly coming out of the apertures. This contributes effectively to providing the jets of fluid produced by the sub-nozzles 10 with the important function of propelling the weft yarn in the weft inserting direction. Therefore, it is understood that the relatively high speed of fluid flow, which effectively contributes to the propulsion of the weft yarn, can be maintained in the region adjacent to the inner surfaces 7*h* and 7*h*′ of the apertures 7*a* and 7*a*′ or the inner surfaces 11*h* or 11*h*′ of the apertures 11*a* and 11*a*′ so that the weft yarn can be prevented from flying out from the apertures. This assures a stable and reliable insertion of the weft yarn. Also, since the propulsion of the fluid jets produced by the sub-nozzles can act sufficiently on the weft yarn, the efficiency of fluid utilization can be increased. This means that the weft yarn can be inserted into the shed with a lower consumption of fluid.

Furthermore, as shown in FIGS. 5A and 5B or FIGS. 6A and 6B, at least each weft guiding member 7 or 11 has an aperture 7*a* or 11*a*, of which at least the inner surface 7*h* or 11*h* is formed in an substantially straightly extending or flat plane. The jet of fluid produced by the sub-nozzle 10 and shown by the reference numerals 10*a* in FIGS. 4, 5A, 6A and 6B advances obliquely through the several apertures 7*a* or 11*a* in the weft guiding members 7 or 11 positioned downstream of the associated sub-nozzles 10 with respect to the weft inserting direction until it strikes against the inner surface or surfaces 7*h* or 11*h* of the aperture or apertures 7*a* or 11*a* further downstream of the apertures 7*a* or 11*a*, through which the fluid jet 10*a* has just advanced. Then, the fluid jet 10*a* is deflected by the inner surface 7*h* or 11*h*. However, since the inner surface 7*h* or 11*h* is formed flat as stated above, there is no fear that the deflected fluid is directed directly toward the opening(s) 7*f* or 11*f* of the aperture(s) 7 or 11 positioned downstream of the aperture, by which the fluid jet 10*a* has been deflected, thereby assuring more reliable weft insertion and further reduced fluid consumption.

It is further stated that although the reflected fluid may flow along the surfaces 7*g* and 7*i* or 11*g* and 11*i* to some extent toward the opening 7*f* or 11*f*, even in this case, it is possible to minimize the amount of fluid escaping from the opening, because the surfaces 7*g* and 7*i* or 11*g* and 11*i* are also formed flat and accordingly cause no circularly swirling flow to occur in the weft guiding channel. Also, this explanation is applicable to any fluid, which is reflected by the surface 7*j* or 11*j*, because the latter is similarly formed flat. Thus, it can be understood that no swirling flow occurs through the weft guiding channel in the direction of the weft insertion, although a flow moving in a zigzag direction may be generated, and that the majority of the fluid flows close to the surfaces 7*h* and 7*h'* or 11*h* and 11*h'* in the weft inserting direction, thus limiting the leakage of fluid through the openings 7*f* and 7*f'* or 11*f* and 11*f'* to a minimum.

Furthermore, according to this invention, each of the weft guiding members is so sized as to have a thickness L larger than or substantially equal to the outer diameter D of the sub-nozzle 10. If the thickness L of the weft guiding member were less than the sub-nozzle outer diameter D, there would be the fear that, when the weft guiding apparatus enters through the group of lower warp yarns, if any of the warp yarns, which extend beside the sub-nozzle and then between the adjacent weft guiding members, deviates from its normal path, it will be trapped in the aperture of the weft guiding member, resulting in a delayed formation of the shed and inviting failure of the weft insertion operation. However, according to this invention, since at least the weft guiding member 7' is in the above-stated dimensional relationship with the sub-nozzle, it will be apparent from FIG. 4 that the warp yarn 4 passing beside either of the diametrically opposite sides of the sub-nozzle 10 can be prevented from being trapped in the aperture 7*a'* of the weft guiding member 7'. Thus, reliable weft insertion can be assured. The more detailed explanation is that since the sub-nozzle 10 is positioned in alignment with the weft guiding member 7' with respect to the direction of the warp and its sharp end is below the upper end of the first curved portion 7*d'* of the weft guiding member 7', the warps 4 can be distributed to the opposite sides of the weft guiding member 7' by the upper end thereof when the weft guiding apparatus enters through the group of lower warp yarns. Therefore, the warp 4 extends beside either of the opposite sides of the weft guiding member 7' as shown in FIG. 4 and it is prevented from being trapped in the aperture 7*a'* of the weft guiding member 7'.

In the case where the thickness L of the weft guiding member 7' is constant and larger than the inner diameter D of the sub-nozzle 10, there is little fear that the warp yarn 4 may be trapped in the aperture 7*a'* thereof. In order to remove this fear, as shown in FIG. 4, the weft guiding member 7' is preferably so shaped as to include parallel surfaces 7*b'*, 7*b'* positioned remote from the sub-nozzle 10, and tapered surfaces 7*c'*, 7*c'* on the sub-nozzle side and converging toward the sub-nozzle 10. The parallel surfaces 7*b'*, 7*b'* serve to keeep the spacing between the guides 7 and 7' substantially constant so as not to cause a disturbance in the condition of the fluid flow flowing through the apertures, and the tapered surfaces 7*c'*, 7*c'* prevent the above-discussed trapping of the warp yarn 4 such as might cause erroneous weft insertion. The guide 7 may also include parallel surfaces 7*b* and tapered surfaces 7*c*.

Although FIG. 4 illustrates an embodiment employing the weft guiding members 7 and 7', of which the thickness L is larger than the outer diameter D of the sub-nozzle 10, the thickness L may be exactly the same as the outer diameter D so as to facilitate the manufacturing of the weft guiding member 7'. In this case, even if the side surfaces 7*c'* of the weft guiding member 7' are not tapered, there will be no fear that the warp yarn 4 is caught in the aperture 7*a'*. Also, in this case, the tapered surfaces 7*c* of the guide 7 may be parallel surfaces 7*c''*.

In the embodiment shown in FIG. 4, all the weft guiding members 7 and 7' have the increased thickness L. The increase of the thickness of each weft guiding member necessarily reduces the spacing between the adjacent weft guiding members, so that the leakage of fluid can be further reduced. However, only the weft guiding member 7' facing the corresponding sub-nozzle 10 need be in the above-discussed dimensional relationship with the sub-nozzle.

It will be apparent to those skilled in the art that the above discussion made in conjunction with FIG. 4 can be applied to the embodiment shown in FIGS. 6A and 6B.

In the embodiment shown in FIGS. 6A and 6B, the fluid outlets 10*b* provided in the sub-nozzle 10 facing the weft guiding member 11' are arranged more inwards of the aperture 11*a* than the inside surface 11*j* of the second arm portion 11*e* of the weft guiding member 11. This arrangement allows the fluid jets 10*a* produced by the sub-nozzle 10 to blow in the apertures 11*a* without interference with the inside surface 11*j* of the second arm portion 11*e* closely adjacent to the associated sub-nozzle 10. Thus, the fluid jets 10*a* can act efficiently on the weft yarn being fed through the weft guiding channel.

Although specific embodiments have been described above, it will be readily understood by those skilled in the art that numerous other arrangements, modifications and adaptations may be conceived without departing from the spirit and scope of the invention.

What we claim is:

1. An apparatus for guiding a weft yarn inserted into a shed, formed between lower and upper warp yarns, by a jet of fluid discharged from a main nozzle positioned beside a jet loom, said apparatus comprising:

a number of weft guiding members arranged in spaced relationship with each other and in parallel to a reed of the jet loom, said weft guiding members each having an aperture with an opening allowing the weft yarn to exit out of the apertures after it has been inserted into the shed, said apertures providing a continuous weft guiding channel;

said weft guiding members being formed of a first group of weft guiding members of which the openings are of a relatively narrow width less than the size of said apertures and are formed in upper parts of said first group of weft guiding members;

sub-nozzles each having at least one fluid outlet discharging a jet of fluid to assist the fluid jet produced by the main nozzle in inserting the weft yarn into the shed, each of said sub-nozzles being positioned between the reed and said guide members with an axis of said at least one fluid outlet inclined at a predetermined angle with respect to the direction of the weft yarn insertion, so that the fluid jet produced by the respective sub-nozzle is obliquely directed toward surfaces of the apertures in said first group of weft guiding members downstream of said respective sub-nozzle with respect to said direction of the weft yarn insertion, which surfaces are positioned away from the reed; and said surfaces of the apertures in said first group of weft guiding members, toward which the fluid jets produced by said sub-nozzles are directed, each extending in a substantially straight direction and substantially vertically in a beat-up position of said weft guiding members.

2. An apparatus as claimed in claim 1, wherein said weft guiding members further are formed of a second group of weft guiding members of which the openings are of a relatively broad width and formed in side parts of said second group of weft guiding members on the side of the reed, each of said second group of weft guiding members being interposed between two adjacent weft guiding members of said first group with their apertures positioned in alignment with each other with respect to said direction of the weft yarn insertion, and each said sub-nozzle being positioned substantially in alignment with a corresponding weft guiding member in said second group with respect to a direction of the warp yarn so as to face the broad opening of the aperture in the corresponding weft guiding member in said second group.

3. An apparatus as claimed in claim 2, wherein the aperture in each of said second group of weft guiding members is defined by substantially straight extending upper, lower and inner surfaces connected together by curved surfaces.

4. An apparatus as claimed in claim 3, wherein each of said first group of weft guiding members comprises a first curved portion providing said substantially straight extending upper, lower and inner surfaces, and a second substantially straight portion providing said outer surface and integrally connected at its lower end with one end of said first curved portion, the other end of said first curved portion being positioned over an upper end of said second portion with a curved narrow gap forming said narrow opening, and each of said second group of weft guiding members comprises a curved portion providing said substantially straight extending upper, lower and outer surfaces and being similar in configuration to the first curved portion of each weft guiding member in said first group, and each of said sub-nozzles comprises a pipe arranged in front of the opening of the aperture in the associated weft guiding member in said second group and having a substantially conical end thereof positioned adjacent to a free end of the curved portion of the associated weft guiding member in said second group so as to form a narrow gap therebetween similar to said curved narrow gap formed in each of said first group of weft guiding members.

5. An apparatus as claimed in claim 2, wherein each of the weft guiding members at least in said second group has a thickness equal to an outer diameter of said sub-nozzles.

6. An apparatus as claimed in claim 2, wherein each of the weft guiding members at least in said second group has a thickness larger than an outer diameter of said sub-nozzles.

7. An apparatus as claimed in claim 5 or claim 6, wherein all of the weft guiding members in said first and second group have the same thickness.

8. An apparatus as claimed in claim 6, wherein each of the weft guiding members at least in said second group includes tapered side surfaces converging toward the associated sub-nozzle.

9. An apparatus as claimed in claim 1, wherein each of said sub-nozzles is arranged so as to position the fluid outlet thereof within said weft guiding channel.

10. An apparatus as claimed in claim 1, wherein the aperture in each of said first group of weft guiding members is defined by substantially straight extending upper, lower, inner and outer surfaces connected together by curved surfaces.

11. An apparatus as claimed in claim 10, wherein said lower surface extends downwardly toward the lower end of said outer surface, and said outer surface extends inwardly toward the outer end of said upper surface.

* * * * *